United States Patent [19]

Kohn

[11] 4,050,889

[45] Sept. 27, 1977

[54] ROTARY OVEN

[75] Inventor: Thomas F. Kohn, Belding, Mich.

[73] Assignee: Belco Industries, Incorporated, Belding, Mich.

[21] Appl. No.: 662,822

[22] Filed: Mar. 1, 1976

[51] Int. Cl.[2] ..... F27B 9/02

[52] U.S. Cl. ..... 432/130; 432/106; 432/124; 432/148

[58] Field of Search ..... 432/10, 106, 124, 148, 432/128, 130, 122

[56] References Cited

U.S. PATENT DOCUMENTS

| | | | |
|---|---|---|---|
| 1,738,038 | 12/1929 | Cope | 432/122 |
| 1,964,344 | 6/1934 | Fasting | 432/106 |
| 2,371,335 | 3/1945 | Kritscher | 432/124 |
| 2,707,629 | 5/1955 | Kennedy | 432/10 |
| 3,455,542 | 7/1969 | Sakamoto | 432/124 |

*Primary Examiner*—John J. Camby
*Attorney, Agent, or Firm*—Glenn B. Morse

[57] ABSTRACT

This oven has a primary heating chamber containing heat-generating equipment producing hot gases. These gases pass from the primary heating chamber to a secondary heating chamber occupied by an indexing rotary magazine in object-exchanging relationship with a mechanism for inducing movement of the objects through the oven. The secondary heating chamber can be used for either pre-heating or heat-soaking the objects, depending on the direction of movement of the objects through the oven. The objects are loaded on the carrier (or removed, according to the application of the oven) radially at a position angularly spaced from the position of exchange with the movement-inducing means.

13 Claims, 20 Drawing Figures

FIGURE 1

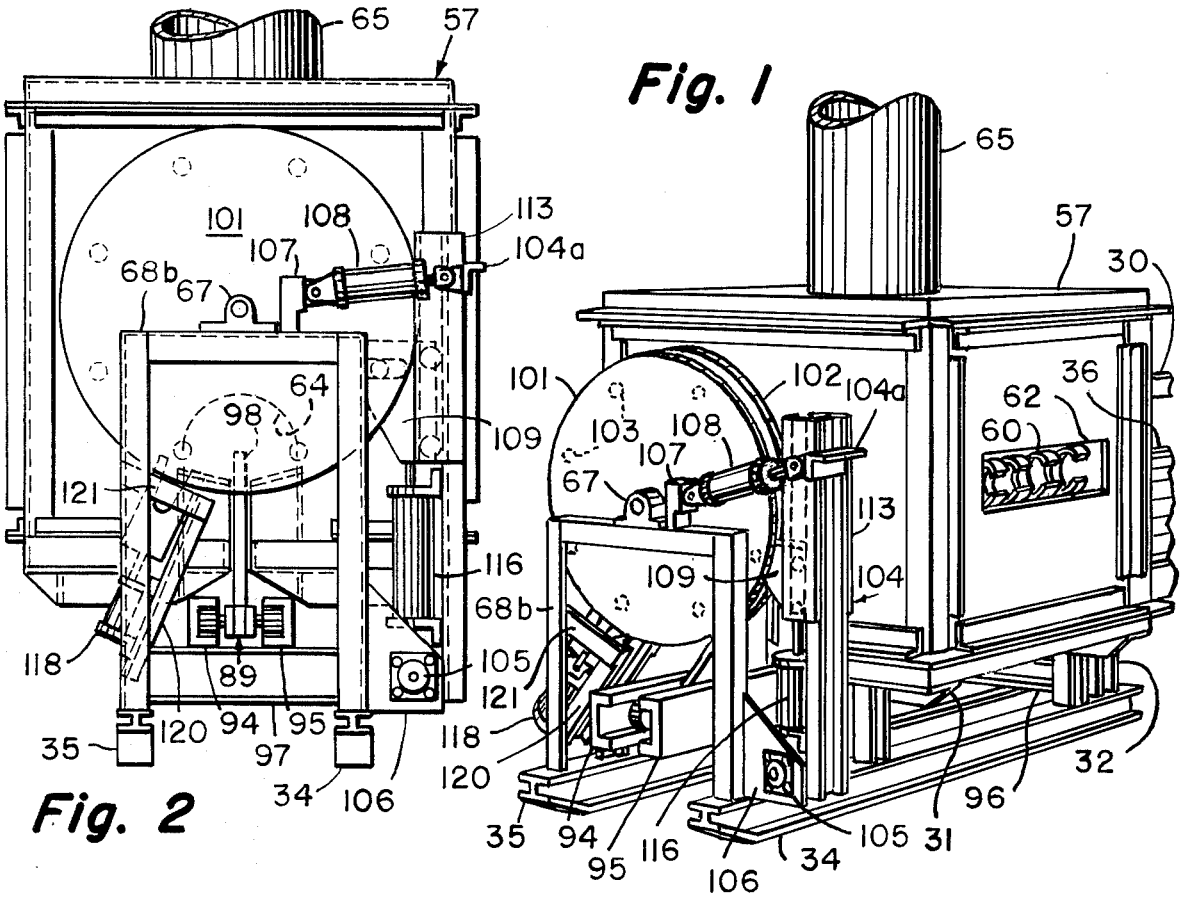
Fig. 1
Fig. 2
Fig. 3
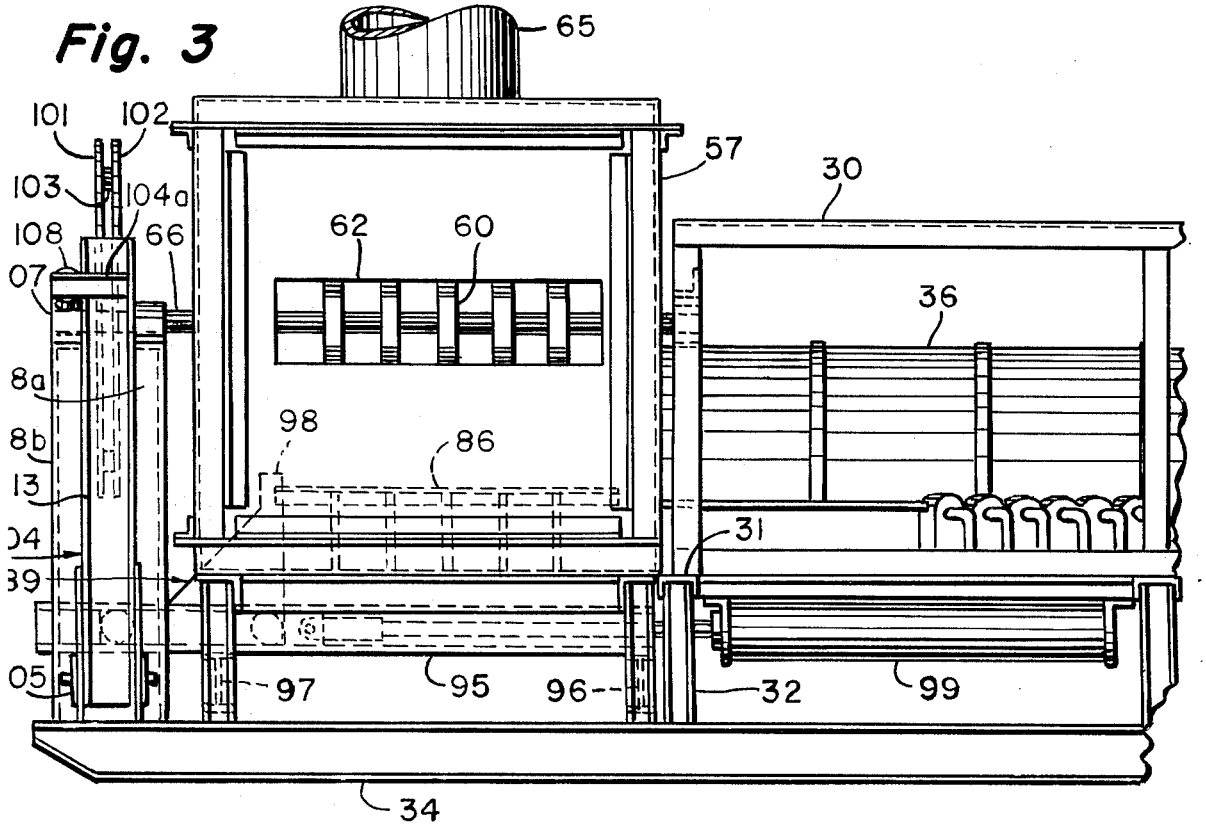

Fig. 6
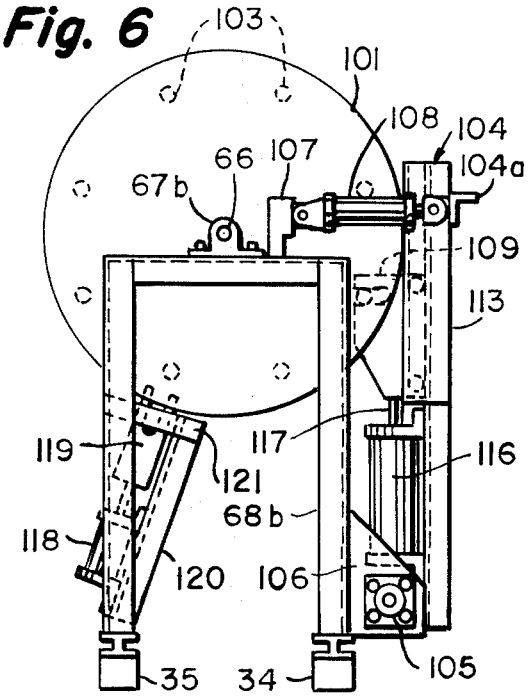
Fig. 7
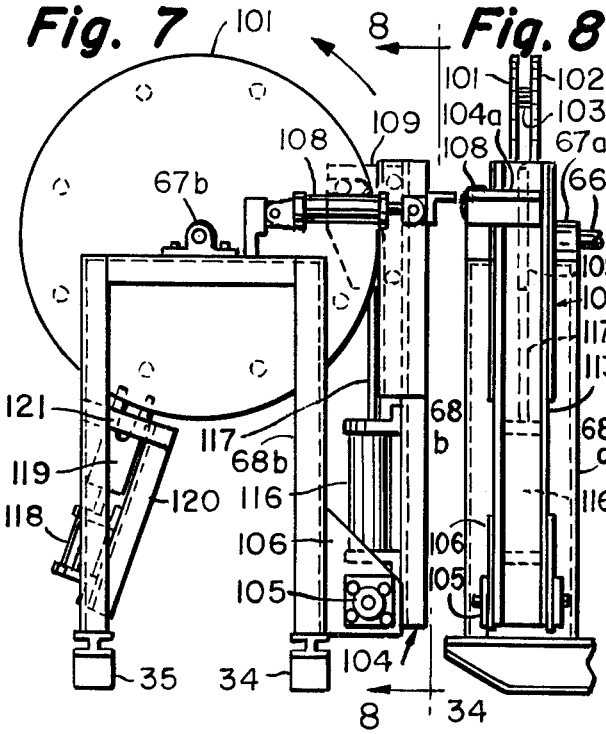
Fig. 8
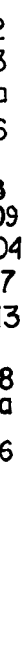
Fig. 9
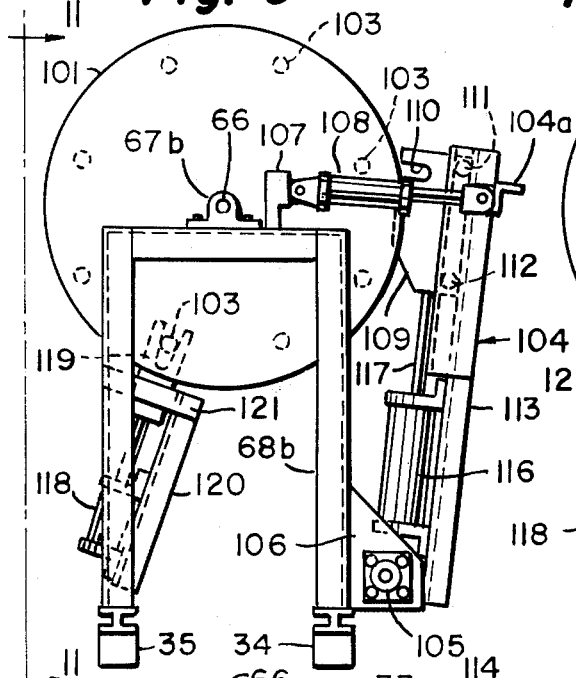
Fig. 10
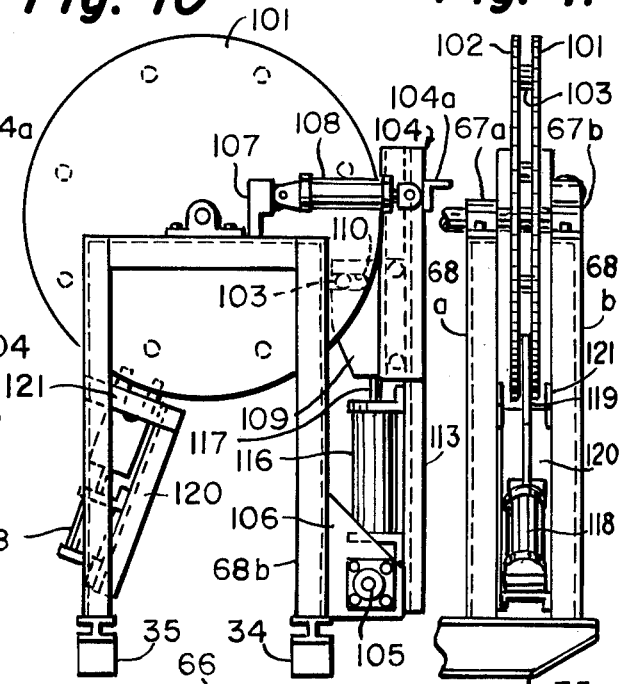
Fig. 11
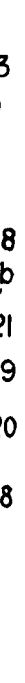
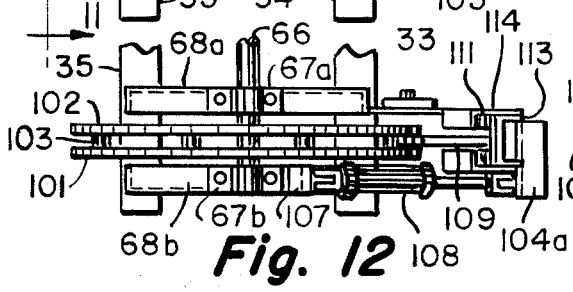
Fig. 12
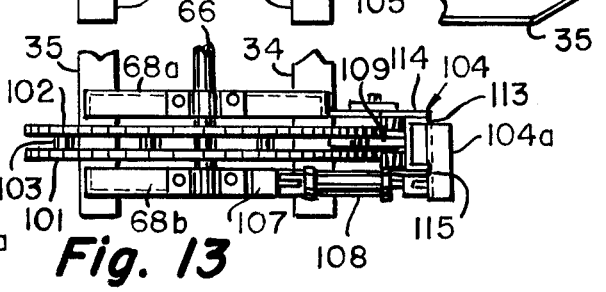
Fig. 13

Fig. 19
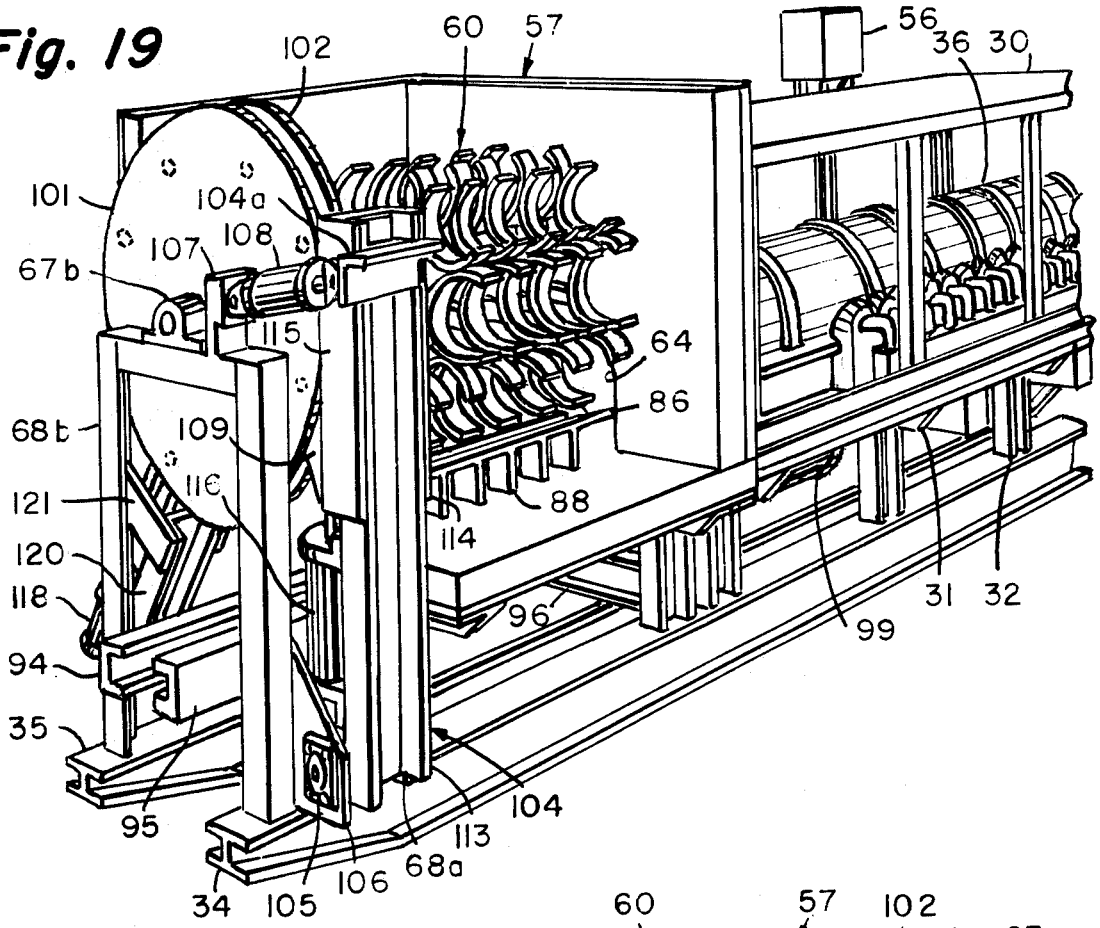
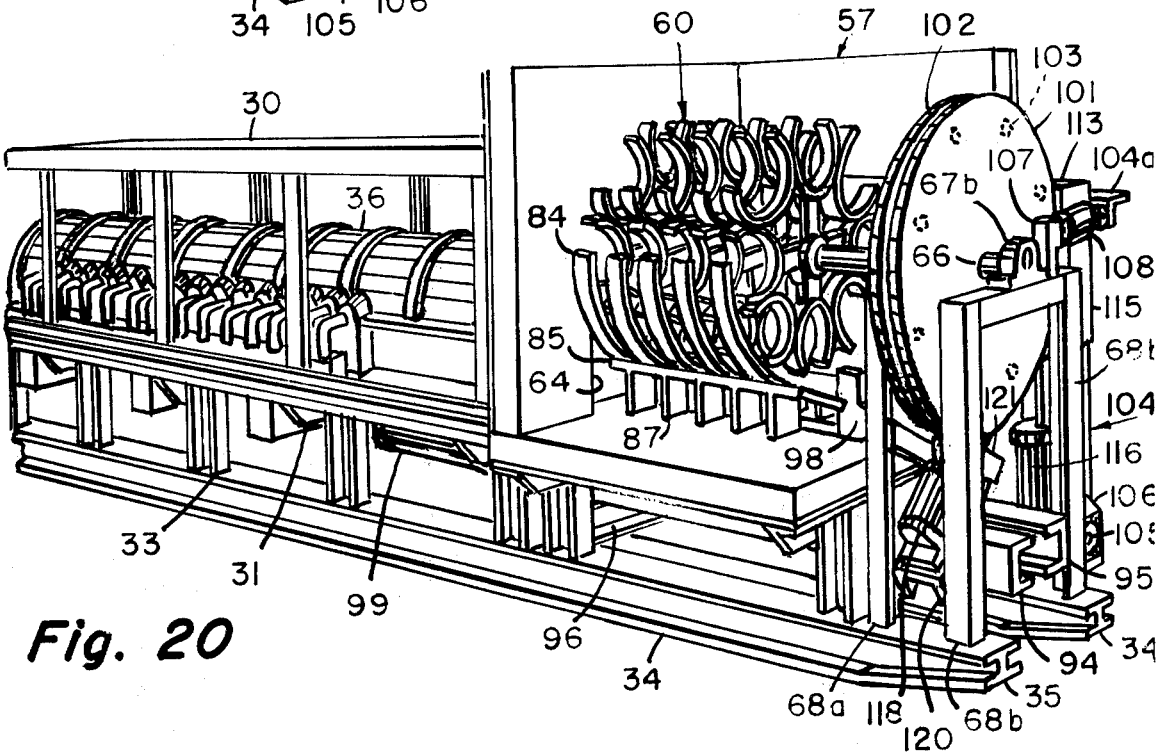
Fig. 20

ROTARY OVEN

BACKGROUND OF THE INVENTION

This invention has been developed in connection with equipment for heating metal billets, either to raise their temperature to a predetermined point for subsequent processing, or to hold the billets for extended periods (known as heat-soaking) to obtain certain alloy characteristics associated with heat treatment. One of the standard forms of oven structure commonly used for this purpose involves an elongated tunnel-like chamber provided with a group of gas burners or other heat-generating means at least along one portion of the structure. Economical use of fuel dictates that the hot gases (including air) within the primary heating chamber be utilized to either pre-heat the billets prior to entrance into the burner area, or maintain the temperature of the billets after they have left this area. The usual construction of elongated ovens of this type is based upon a sufficient length of the tunnel so that a large portion of the length of it is used as secondary heating chamber by including means for inducing movement of the hot gases from the primary chamber along the full length of the structure. Some sort of conveyor is incorporated to induce movement of the billets through the tunnel. When the oven is used merely to raise the billets to a predetermined temperature, a counterflow arrangement between the gas movement and the direction of movement of the conveyor is used so that the relatively cool billets are exposed to the fuel gases in the secondary heat chamber before the billets are received in the area provided with the primary heating equipment. The heat-soaking procedure is somewhat the reverse of this, in that the billets are admitted first to the primary heating chamber and raised quickly to the desired temperature. They are then carried on into the secondary heating chamber, where the presence of the hot gases from the primary chamber serve to maintain the temperature of the billets for the time desired to obtain the necessary alloy characteristics.

Where large metal billets are processed in considerable quantity, the length of the conventional oven structure becomes a problem both with regard to the cost and also to the floor space requirements. It is also obvious that the standard elongated oven in which part of its length is used as a secondary heating chamber exposes the billets to a temperature gradient as the gases are progressively cooled by transmission of their heat to the billets, and by heat loss through the oven structure. Where the heat-soaking procedure is being used, exposure of the billets to a temperature gradient, rather than to a constant temperature, may present a severe limitation where a precise control is necessary.

Applicant has noted the existance of the following patents that are considered pertinent to this type of oven construction:

Kennedy: U.S. Pat. No. 2,707,629, 1955
Jenkins, Sr.: U.S. Pat. No. 1,615,627, 1927
Adams, Jr.: U.S. Pat. No. 2,013,905, 1935
Spain: U.S. Pat. No. 828,865, 1906
Larsson: U.S. Pat. No. 1,763,624, 1930
Johnson, et. al.: U.S. Pat. No. 2,762,618, 1956
Heinemann: U.S. Pat. No. 3,319,349, 1967

SUMMARY OF THE INVENTION

The present invention provides a solution to the above problems by replacing at least a portion of the length of the usual secondary heating section of an elongated oven with a rotary holding magazine. This length, incidentally, would normally be established by the combined consideration of the length of time that the billets are to be exposed to the elevated temperatures, and the velocity of the billets through the oven. Using these same design criteria, the rotary holding magazine has the effect of (a) shortening the length of the oven structure and its floor space requirements, (b) assuring a greater uniformity of heat transfer to the billets, and (c) substantially removing the temperature gradient normally associated with a tunnel oven. Billets are loaded preferably laterally into the rotary magazine, which is indexed in angular increments corresponding to positions in which receptacles on the magazine are placed in alignment with the path of movement of the billets through the oven. This conveyor mechanism serves then to move the billets successively out of the receptacles and along the path through the oven. The preferred indexing mechanism is exterior to the oven structure, and includes a wheel-type element mounted on the rotary magazine shaft. Abutments on this wheel structure are engaged by a pivoted indexing system in which the jaws of an actuator are successively engaged with these abutments to induce rotation through a predetermined sector.

DESCRIPTION OF THE DRAWINGS

FIG. 1 is a perspective view of the exterior of the secondary heating chamber of an oven embodying the present invention.

FIG. 2 is an end elevation of the structure shown in FIG. 1.

FIG. 3 is a side elevation of the structure shown in FIG. 1.

FIG. 6 is a view of the indexing system of the oven in a position corresponding to the initial unlocking and engagement of the indexing mechanism prior to the beginning of the induced rotary motion.

FIG. 7 illustrates the second stage of the indexing movement, in which the rotary magazine, or carrier, has been moved through a sector corresponding to the distance between one billet receptacle and another.

FIG. 8 is a side elevation corresponding to FIG. 7.

FIG. 9 illustrates the final stage in the indexing mechanism, in which the motion-inducing system is disengaged, and the locking mechanism engaged to maintain the position of the rotary magazine.

FIG. 10 illustrates the re-engagement of the rotation-inducing system preparatory to the next increment of rotation.

FIG. 11 is a side elevation at the left with respect to FIG. 10.

FIG. 12 is a top view with respect to FIG. 9.

FIG. 13 is a top view with respect to FIG. 10.

FIG. 19 is a perspective view of the end of the oven structure containing the secondary heating chamber, with a portion of the housing removed to illustrate the interior features.

FIG. 20 is a perspective view of the structure shown in FIG. 19 from the opposite side, with a correspondingly opposite part of the housing removed.

DESCRIPTION OF THE PREFERRED EMBODIMENT

Figure 4:
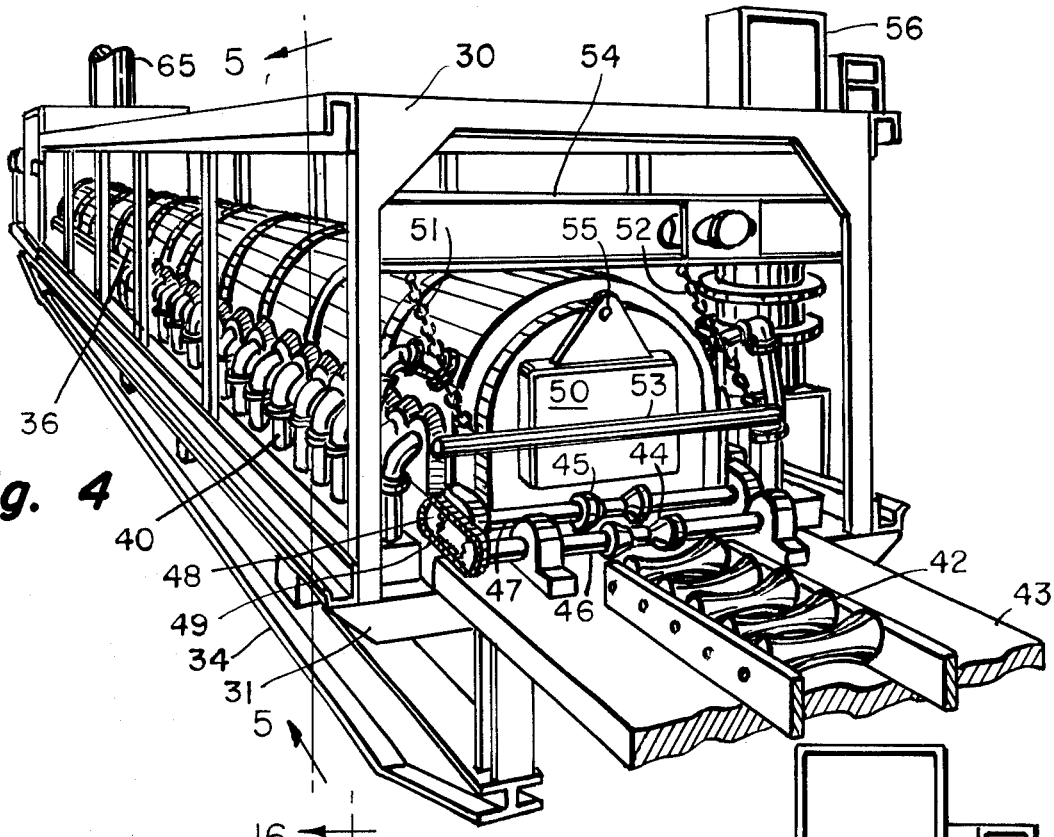
FIG. 4 is a perspective view at the opposite end of the oven from that appearing in FIG. 1.
Figure 5:
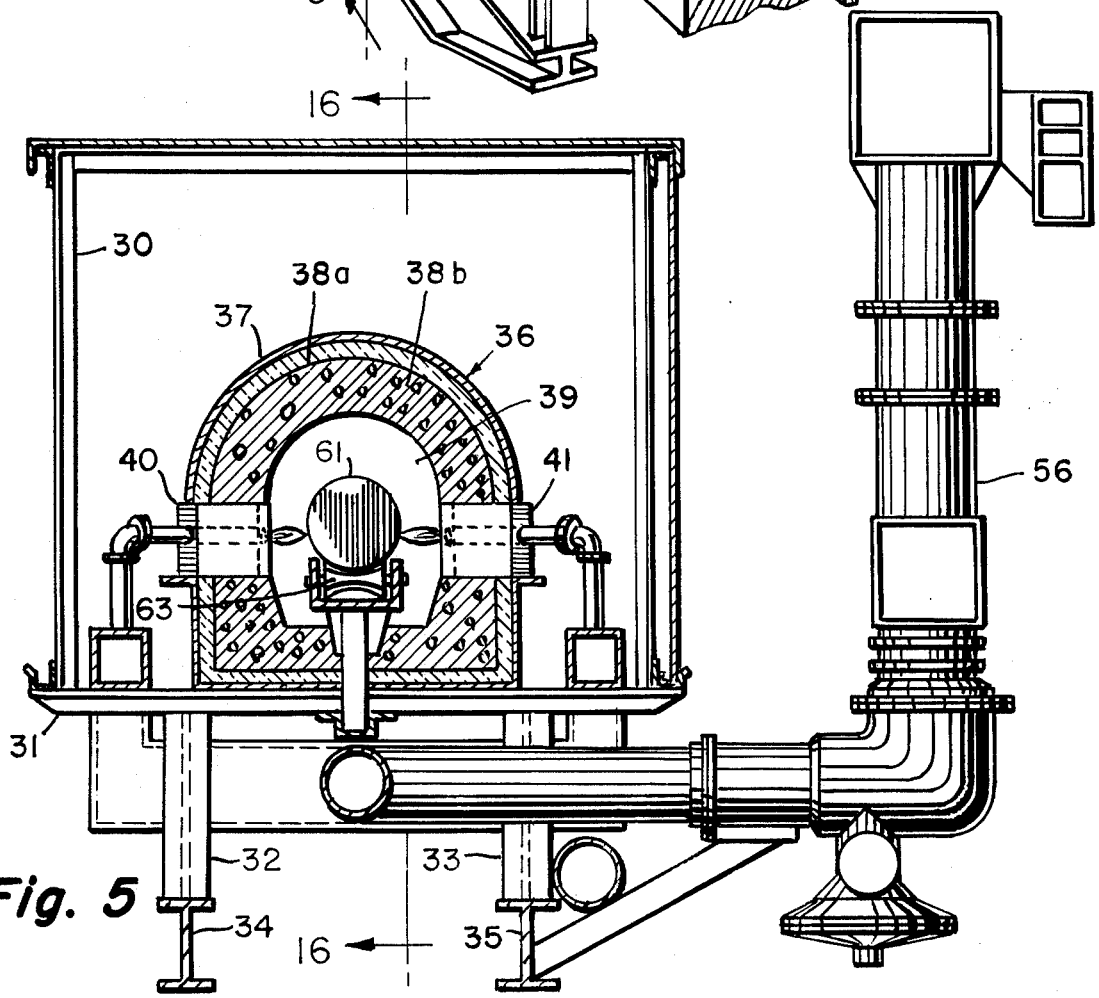
FIG. 5 is a section on the plane 5—5 of FIG. 4.
Figure 18:
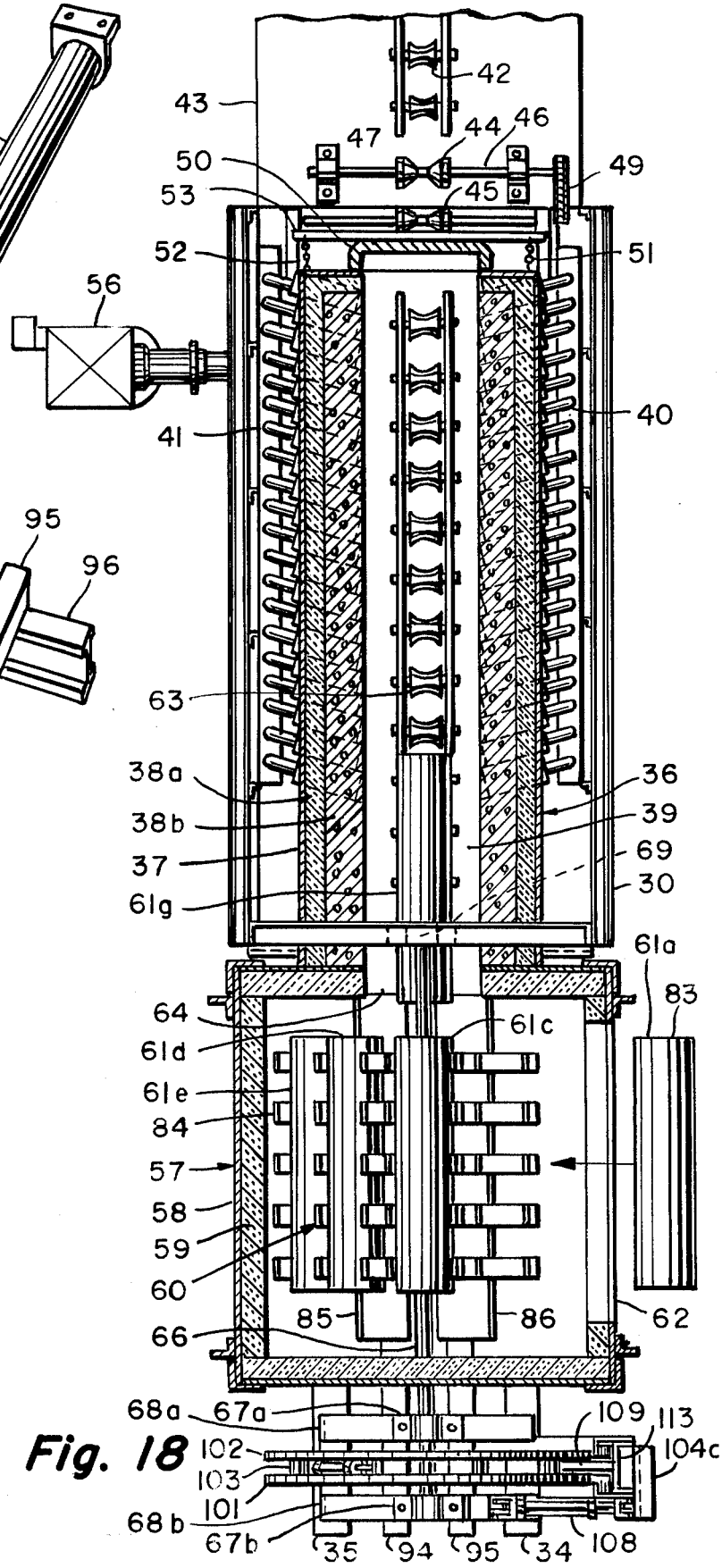
FIG. 18 is a section on horizontal plane through the oven structure.

The oven illustrated in the drawings has a frame including the over head structure 30, a group of horizontal beams 31 providing a support platform, and legs as shown at 32 and 33 in FIG. 5 extending from this platform to the floor rails 34 and 35, respectively. The tunnel structure generally indicated at 36 rests on the platform provided by the members 31, and includes the usual outer shell 37 and insulation material 38 defining the primary heating chamber 39. A group of gas burners as shown at 40 and 41 in FIG. 5 are arranged on opposite sides of the tunnel structure 36, and direct a torch-like blast of combustion gases at an angle with respect to the axis of the chamber 39 to induce movement of these gases from right to left as shown in FIG. 4, and from top to bottom, as shown in FIG. 18. The exterior roller system shown at 42 in FIG. 4, together with its support 43, is conventional. These rollers are normally arranged at a sufficient incline so that the billets can move under the action of gravity. The rollers 44 and 45 respectively mounted on the shafts 46 and 47 supported in bearings mounted on the structure 43, and are driven by the motor 48 and the chain and sprocket system 49. This arrangement is conventional. The door is moveably supported by the chains 51 and 52 extending from the bar 53, secured to the door, to the beam 54 forming part of the overhead structure 30. A lifting device or mechanism of any convenient form can be applied to the tab 55 of the door to open it to permit passage of the billets to or from the rolers 42, and 44–45. Combustion gases are admitted to the burner system through the conventional manifold arrangement generally indicated at 56 in FIG. 5.

The secondary heating chamber generally indicated at 57 includes the housing 58, the usual insulation 59, and the rotary magazine or billet-carrier generally indicated at 60. Billets as shown at 61 in FIG. 18 are fed laterally through the opening 62 in the housing into one of the receptacles of the rotary carrier, to be discharged later into the path of movement of billets through the oven established by the conveying rollers 63. Flue gases from the primary heating chamber enter the secondary heating chamber at the opening 64, and exhaust upwardly through the stack 65.

The shaft 66 of the carrier 60 is supported at one end by the bearings 67*a*-b mounted on the U-shaped structures 68*a*-b secured at opposite ends to the floor rails 34 and 35, as best shown in FIG. 20. The opposite end of the shaft 60 is supported in the bearings 69 mounted on the frame of the oven exteriorly of the tunnel structure 36 extending from the primary heating section of the oven. These bearings are therefore outside of the influence of elevated temperatures within the oven. A series of axially-spaced hubs 70 is secured to the shaft 66, and each of these hubs has a group of four spokes 71–74. The arcuate receptacles 75–78 are respectively secured to the outer extremities of these spokes. The intermediate receptacles 79–82 are secured at their opposite sides, respectively at the adjacent receptacles, so that the entire group is supported by the spokes. The receptacles preferably extend around a sector slightly in excess of 180°, and are all outwardly open so that a billet as shown at 83 in FIG. 14 can be admitted through the opening 62, and inserted in whichever of the receptacles happens to be opposite the opening at that moment. As viewed in FIG. 14, the indexing movement of the carrier is counter-clockwise, and the extent of the receptacles around a sector in excess of 180° results in maintaining the billets within the embrace of the receptacles over the upper half of the circular path of travel induced by the rotary carrier. On the descending side of the path (at the left of FIG. 14), the billets are retained within the spacing influence of the receptacles by the arcuate retaining bars 84. As the billets approach the axis of the opening 64, they are, in effect, rolling down the arcuate bars 84 onto the V-shaped platform provided by the plates 85 and 86 supported, respectively, on the legs 87 and 88 secured to the fixed structure of the oven.

Figure 14:
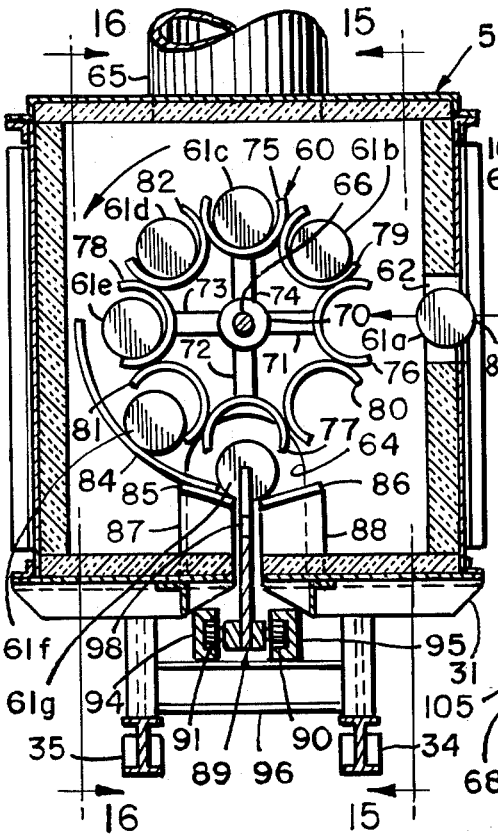
FIG. 14 is a transverse section through the secondary heating chamber and the rotary carrier, on the plane 14—14 of FIG. 15.
Figure 15:
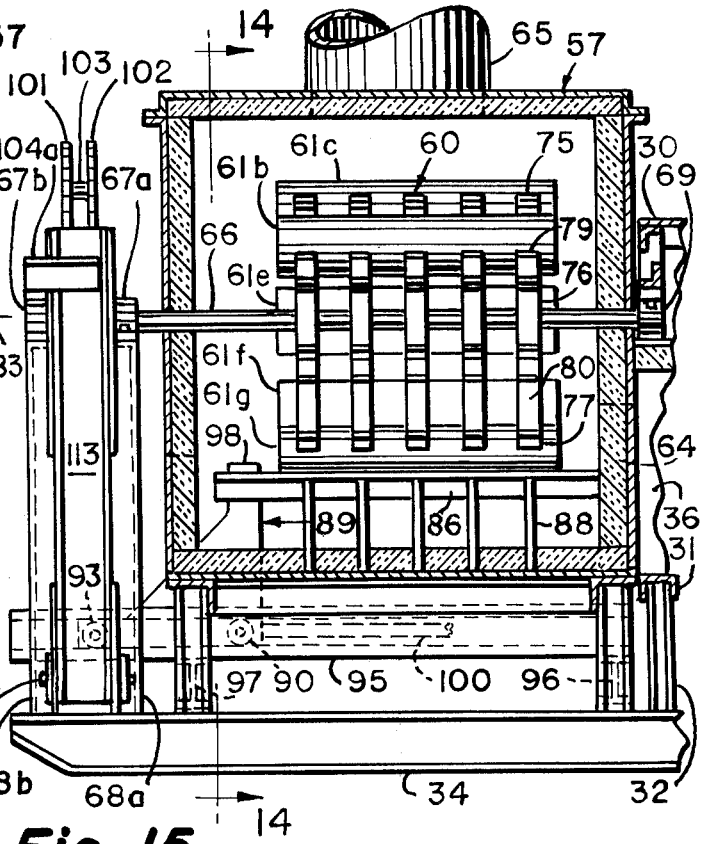
FIG. 15 is a section on the plane 15—15 of FIG. 14.
Figure 16:
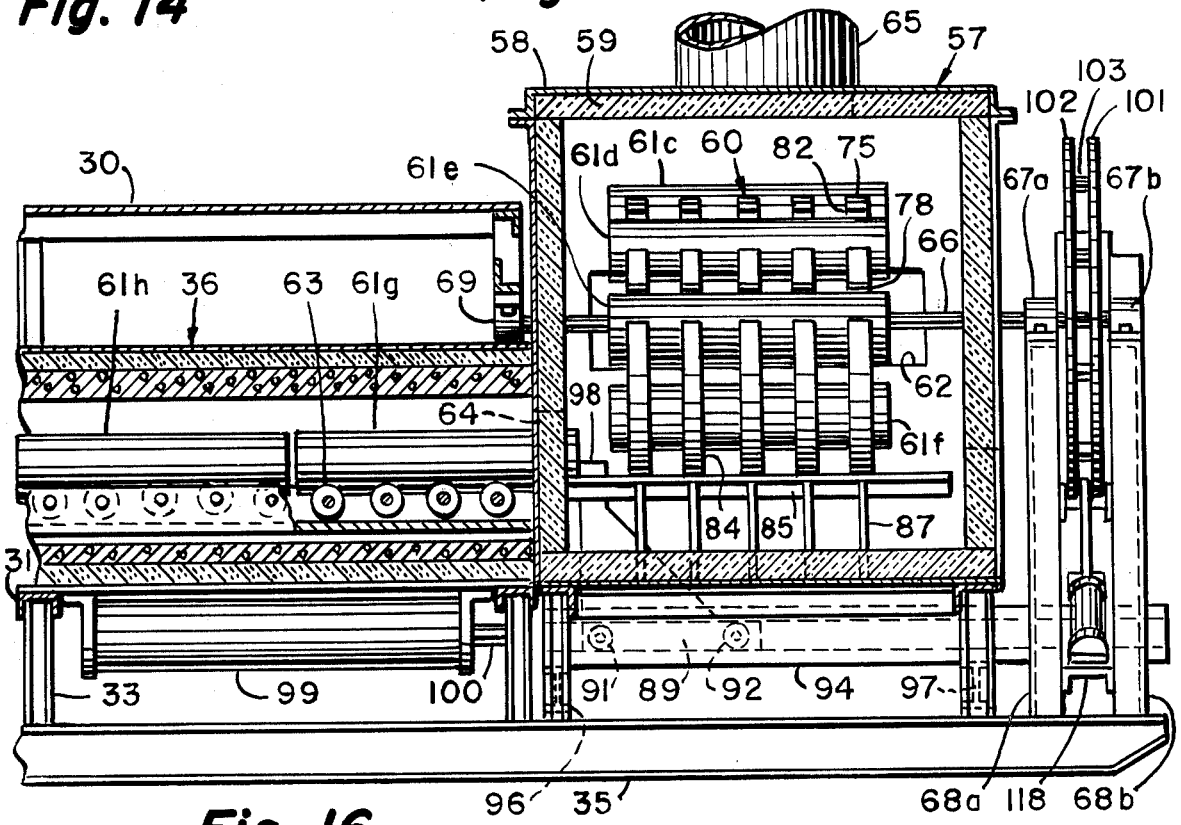
FIG. 16 is a section on the plane 16—16 of FIG. 5.
Figure 17:
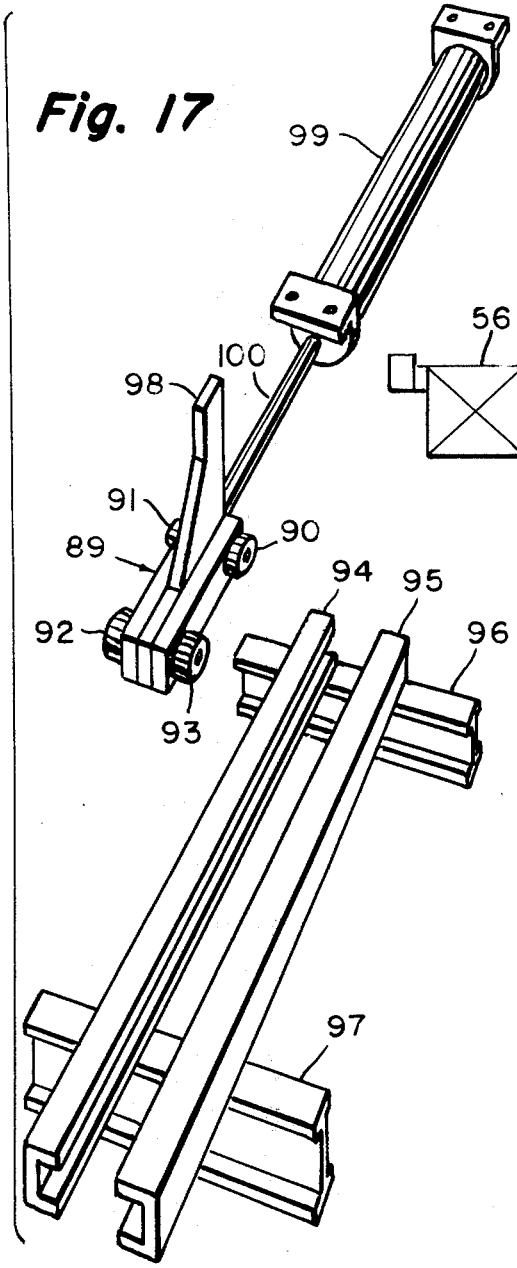
FIG. 17 is an exploded view showing the principal components of the mechanism for inducing movement of the billets through the oven, including the guideway structure, the actuating member, and the hydraulic cylinder.

Movement of the billets through the oven is induced by the mechanism shown in FIGS. 17 and 14. The carriage generally indicated at 89 has a group of rollers 90–93 received between the spaced rails 94 and 95 mounted on the cross members 96 and 97 of the frame of the oven. The rails 94 and 95 embrace the rollers on the opposite sides of the carriage 89, as best shown in FIG. 14. The actuator 98 extends upwardly between the rails 94 and 95, and also between the plates 85 and 86 which position the billets successively for movement along the axis of the oven. Movement of the carriage is induced by the hydraulic cylinder 99 mounted on the frame of the oven. The piston rod 100 of the cylinder 99 is connected directly to the carriage 89. The extended position of the cylinder 99 places the actuator 98 as shown in FIG. 15, leaving the rotary carrier free to index so that a billet may be placed as shown in FIG. 14. Contraction of the cylinder 99 brings the actuator 98 to bear against the end of the billet, shoving it through the opening 64, and shoving the entire line of billets ahead of it through interengagement of the ends of the billets one with another.

The indexing mechanism for inducing rotation of the carrier 60 is shown best in FIGS. 6–13. A pair of spaced discs 101–102 is secured to the shaft 66, and a group of short cylindrical abutments 103 is interposed between the discs and secured firmly to both of them. These abutments are angularly spaced about the axis of the shaft 66 in regular intervals, and are disposed radially inward from the periphery of the discs. A tangent arm 104 is pivotally mounted in the bearings 105 secured to the bracket 106 on the U structure 68. Another bracket 107 mounted on the top of this structure forms a terminal for the hydraulic cylinder 108. The outer end of the piston rod of this cylinder is pivotally connected to the bracket 104*a* on the arm 104, with a result that extention and retraction of the cylinder 108 induces a shifting in position of the arm 104 between the relationship shown in FIG. 9 to that in FIG. 10. A plate 109 has a cutout 110 forming a jaw engageable with the abutments 103. This plate has rollers as shown at 111 and 112 in FIG. 9 received between the beam 113 forming the backbone of the tangent arm 104 and the flanges of the retaining members 114 and 115, which are also secured to the beam 113. The hydraulic cylinder 116 has its piston rod 117 secured to the plate 109, so that contraction and extention of the assembly induces movement along the beam 113. The plate 109 is normally between the discs 101 and 102 at all times, which serves to maintain the position of the plate for engagement with the abutments 103 without particularly close construction tolerances. With this structure, the indexing of the carrier 60 is thus a sequence of actuations by the cylinders 107 and 116. Contraction of the cylinder induces a movement of the tangent arm assembly 104 from the FIG. 9 to the FIG. 10 position, causing the jaw 110 to engage one of the abutments 103. In this position, the actuation of the cylinder 116 induces rotation through a sector corresponding to the spacing of the abutments 103. When the new indexed position is reached, the cylinder 118 mounted on the frame of the oven induces movement of the locking jaw 119 along a guideway produced by the fixed rail 120 so that the opposite abutment is locked securely. The rail 120 is secured to the U structure 68 by the strap 121 at the upper extremity of the rail, and directly to the U structure at the lower end.

The operating effect of the structure described above is to subject the billets to a continually varying position within the secondary heating chamber over an extended period of time. The rotation of the billets as they are thus exposed improves the uniformity of the heating, and the movement of the exhaust gases from the horizontal entrance into the secondary heating chamber, followed by the upward movement through the chamber to the stack 65, subjects the billets to a transverse flow which improves the heat-exchanging characteristics considerably. The effect of the rotary carrier is thus not only to maintain the billets under the influence of elevated temperatures for a length of time corresponding to a much greater length of tunnel oven, but to completely change the nature of the heat exchanging relationship between the flue gases and the billets. This arrangement has the desirable effect of eliminating the temperature gradient charcteristic of plain tunnel ovens.

I claim:

1. An oven having a primary heating chamber including heat-generating means and means for inducing movement of gases through said primary heating chamber, means for inducing movement of objects along a path through said primary heating chamber, and a secondary heating chamber communicating with said primary heating chamber and traversed by said path and by said gases, wherein the improvement comprises:

an object carrier rotatably mounted in said secondary heating chamber, said carrier having a plurality of receptacles angularly spaced about the axis of rotation thereof; and indexing means adapted to rotate said carrier to positions successively placing said receptacles for engagement of said movement-inducing means with objects carried by said receptacles.

2. An oven as defined in claim 1, wherein said carrier has an axis of rotation parallel to and above said path, and said path is substantially horizontal.

3. An oven as defined in claim 1, wherein said carrier has an axis of rotation disposed outside the projected periphery of the adjacent portion of said primary heating chamber.

4. An oven defined in claim 3, wherein said carrier has a shaft traversing said secondary heating chamber, and said secondary chamber includes bearing means for said shaft mounted exteriorly of said primary and secondary heating chambers.

5. An oven as defined in claim 1, wherein said primary heating chamber is an elongated horizontal tubular structure, and said carrier rotates on a horizontal axis above said path, said secondary heating chamber having an exhaust stack in the upper portion thereof.

6. An oven as defined in claim 1, wherein the direction of induced movement of said objects is from said secondary heating chamber toward said primary heating chamber, and additionally including means for inducing movement of said gases in the opposite direction thereto.

7. An oven as defined in claim 1, wherein the direction of induced movement of said objects is from said primary heating chamber toward said secondary heating chamber, and additionally including means for inducing movement of said gases in the same direction thereto.

8. An oven as defined in claim 1, wherein said carrier is adapted to move said receptacles around a sequence of positions, one of which is substantially aligned with said path, said receptacles being radially outwardly open, and said movement-inducing means includes a member adapted to traverse said receptacles in said one position in a direction parallel to said path.

9. An oven as defined in claim 8, wherein said movement-inducing means member is moveably mounted on a guideway fixed with respect to said secondary heating chamber, and further includes reciprocating actuating means adapted to generate movement of objects out of said carrier in sequence.

10. An oven as defined in claim 1, wherein said indexing means includes a frame fixed with respect to said secondary heating chamber, a shaft coaxial and fixed with respect to said carrier, a plurality of abutments at regularly angularly spaced positions about said shaft and fixed with respect thereto in substantially coplanar relationship, a tangent arm pivotally mounted on said frame on a pivot axis parallel to said shaft, actuating means including a member mounted for movement along said arm and having jaw means disposed to engage said abutment means successively in a direction substantially radial with respect to said shaft, positioning means adapted to rotate said arm to and from a position wherein said jaw means can receive said abutment means, said actuating means being adapted to induce rotary movement of said carrier through a sector corresponding to the angular spacing of said abutment means, the disposition of said abutment means corresponding to placement of said receptacles successively at said path.

11. An oven as defined in claim 10, wherein said indexing means is exterior to said secondary heating chamber and includes spaced discs secured to said shaft and having said abutment means interposed between said discs and secured thereto.

12. An oven as defined in claim 11, wherein said discs extend radially beyond said abutments, and said jaw means is normally received between said discs in all positions of said arm.

13. An oven as defined in claim 10, additionally including locking means adapted to hold said carrier in the successive angular positions established by said actuating means.

* * * * *